US006148510A

United States Patent [19]

Yokoi et al.

[11] Patent Number: 6,148,510

[45] Date of Patent: Nov. 21, 2000

[54] METHOD FOR PRODUCING TERMINAL WIRE CONNECTION

[75] Inventors: Kiyonori Yokoi; Hideo Kikuchi; Akinori Mori; Seiji Endou; Shizuyoshi Satou, all of Kanuma, Japan

[73] Assignee: Sumitomo Electric Industries, Ltd., Osaka, Japan

[21] Appl. No.: 09/069,100

[22] Filed: Apr. 29, 1998

[51] Int. Cl.[7] ..... H01B 13/20

[52] U.S. Cl. ..... 29/828; 29/868; 29/878; 29/867; 174/84 R

[58] Field of Search ..... 29/828, 860, 867, 29/868, 878, 879; 174/84 R, 261

[56] References Cited

U.S. PATENT DOCUMENTS

| | | | |
|---|---|---|---|
| 3,221,290 | 11/1965 | Stark et al. | 339/177 |
| 4,602,832 | 7/1986 | Cunningham et al. | 339/14 R |
| 5,281,762 | 1/1994 | Long et al. | 174/78 |
| 5,347,711 | 9/1994 | Wheatcraft et al. | 29/843 |
| 5,387,764 | 2/1995 | Blom et al. | 174/261 |
| 5,768,771 | 6/1998 | O'Sullivan et al. | 29/828 |
| 5,781,991 | 7/1998 | Papon | 29/828 |
| 5,815,916 | 10/1998 | Luc | 29/828 |
| 5,889,253 | 3/1999 | Kanaoka | 219/121.61 |
| 5,940,963 | 8/1999 | Tolmie et al. | 29/828 |
| 6,009,621 | 1/2000 | Nishi et al. | 29/857 |

*Primary Examiner*—Lee Young
*Assistant Examiner*—Minh Trinh
*Attorney, Agent, or Firm*—Pillsbury Madison & Sutro, LLP

[57] ABSTRACT

An electric wire work is produced in the following manner. That is, a combination of a plurality of coaxial cables are cut to a predetermined length. External conductors are exposed in the vicinity of the ends thereof. The external conductors is fixed at a predetermined pitch with a ground bar. Insulators are exposed outside the ground bar. The plurality of insulated cores are fixed at a predetermined pitch with a plastic tape. Then, the insulator layers are shifted together with the plastic tape at a point between the ground bar and the plastic tape so that core conductors 7 are exposed.

4 Claims, 4 Drawing Sheets

METHOD FOR PRODUCING TERMINAL WIRE CONNECTION

BACKGROUND OF THE INVENTION

1. Field of the Invention

The present invention relates to an extremely fine coaxial cable for high speed transmission. More particularly, the present invention relates to electrical wire work which is subjected to terminal work so as to adapt for liquid crystal displays for personal computers and a method for the production thereof.

2. Description of the Related Art

In order to increase the number of pixels and colors on a liquid crystal display used for a personal computer, it has been desired to speed up the image signal. To this end, coaxial cables comprising a fluororesin having a small dielectric constant as a dielectric material have been used.

In recent years, accompanying with the spread of note type personal computers, there is a demand for personal computers, to be small and light. Cables to be incorporated in these computers are required to match characteristic impedance within a narrow space to a high precision. In order to meet this demand, it must be made sure during the operation for the connection of the cables that the external conductor is grounded and the core conductors are connected to connector terminals having a predetermined pitch or to circuits on a circuit board. This operation takes much time.

SUMMARY OF THE INVENTION

It is an object of the present invention to provide electrical wire work which is subjected to terminal work to efficiently effect a connection of a plurality of extremely fine coaxial cables for use in a liquid crystal display for a personal computer, etc.

DETAILED DESCRIPTION OF THE INVENTION

Figure 1:
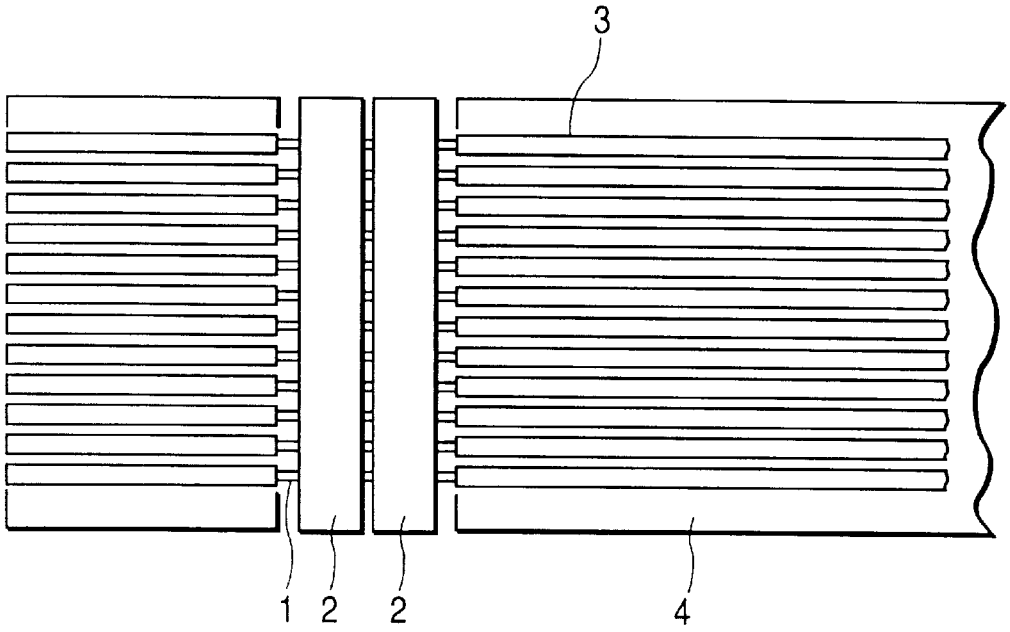
FIG. 1 illustrates how two sets of ground bars are soldered to spirally wound external conductors which have been exposed by shifting outer coatings.

Detailed description of the present invention will be described as follows.

In order to efficiently effect the connecting operation, it has been a common practice to arrange a plurality of coaxial cables at a predetermined pitch to make a flat cable 4 that allows them to be connected collectively. However, a marked problem is that the connection part obtained by the collective connection lacks strength because the diameter of coaxial cables is reduced. The inventors made extensive studies of solutions to these problems. As a result, it was found that the collective connection can be efficiently effected by providing to users an electric wire work in which the terminals are worked in the following procedure so as to facilitate collective connection even if the diameter of the coaxial cables are extremely small. Thus, the present invention has been accomplished.

The terminal process according to the present invention is effected in the following procedure:

(1) A plurality of coaxial cables are arranged at a predetermined pitch, and then fixed at the predetermined pitch with an adhesive tape.

(2) The combination of coaxial cables is cut to a predetermined length.

(3) The combination of cables is irradiated with a laser beam at a point in the vicinity of the ends thereof to form a slit thereon. Coatings and copper-metallized polyester tape layers are then shifted to a removing direction to expose spirally wound shield layers.

(4) Two sets of ground bars (metallic foil) are fixed to the spirally wound shield layers with solder.

(5) The cables are bent vertically at a point in the vicinity of the middle portion of the two sets of ground bars to cut the spirally wound shield layers.

(6) The spirally wound shield layers are removed together with one of the ground bars in the side of end to expose the insulator layers.

(7) A plastic tape is heat-fused to the insulator layers so that the insulated cores are fixed at a predetermined pitch.

(8) The insulators are irradiated with a laser beam at a point between the other ground bar and the plastic tape to form a slit thereon.

(9) The outer insulators are shifted in the removing direction to expose core conductors.

(10) The combination of cables is cut at a point outside the plastic tape.

Thereafter, the ends of this electric wire work may be dipped in a solder bath so that the core conductors made of twisted wires are collectively coated with solder. Further, the adhesive tape may be peeled off the combination of cables to provide an electric wire work which is fixed at the predetermined pitch only at a point between the ground bar and the plastic tape but is free at the other part to increase the degree of freedom of wiring or freedom of use of a circuit thus wired.

EXAMPLES

The present invention will be further described in the following examples.

A core conductor made by twisting seven tin-plated copper alloy wires having a diameter of 0.03 mm was insulated with a fluororesin coating having a thickness of 0.06 mm. A tin-plated copper alloy wire having an element wire diameter of 0.03 mm was then spirally wound on the insulated wire so that it was shielded. A copper-metallized polyester tape was wound on the wire while the copper-metallized side thereof faces inward to form a shield layer. A colored polyester tape was then wound on the wire as an outer coating 3 to form an extremely fine coaxial cable having an outer diameter of 0.33 mm. Twenty coaxial cables were arranged in parallel at a pitch of 0.5 mm. An adhesive tape was then applied to the combination of coaxial cables at the upper and lower sides thereof so that the coaxial cables were fixed at the pitch.

The tape-shaped cable thus obtained was then cut to a length of 180 mm. The combination of cables was then irradiated with a laser beam at a position of 15 mm from the both ends thereof so that a slit was formed thereon. The adhesive tape, the coating and the copper-metallized polyester tape layer were collectively shifted in a direction removing from the combination of cables so that the external conductors formed by spirally winding a tin-plated copper alloy wire were exposed.

Figure 2:
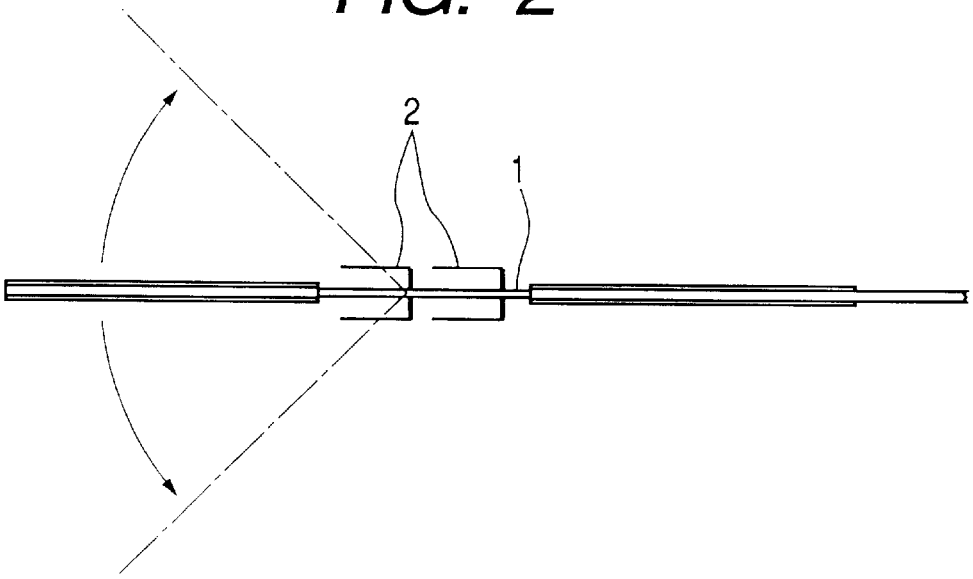
FIG. 2 is a sectional view of FIG. 1.

The external conductors 1 thus exposed were then vertically clamped by two sets of tin-plated phosphor bronze ground bars 2 having a width of 1 mm and a thickness of 0.5 mm. These ground bars were soldered to the external conductors 1 as shown in FIGS. 1 and 2. FIG. 1 is a plan view. FIG. 2 is a sectional view.

Figure 3:
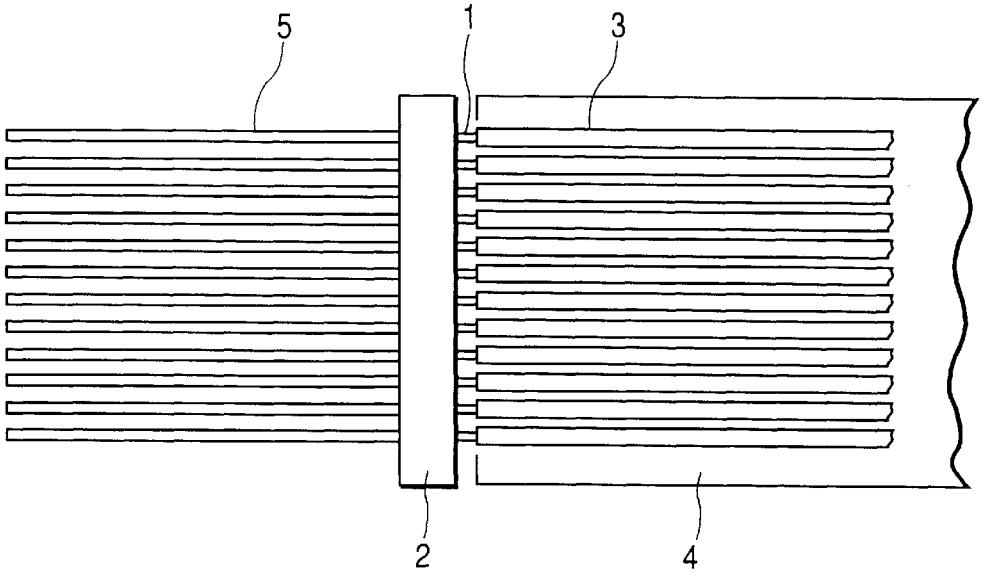
FIG. 3 illustrates how the insulators are exposed by removing the external conductors together with the outer one of the two ground bars.

Subsequently, as shown in FIG. 2, the cables were bent vertically at a point in the vicinity of the middle portion of the two sets of ground bars 2 to cut the external conductors 1. The external conductors at the end of the plurality of cables were then collectively removed away so that the insulators 5 were exposed as shown in FIG. 3.

Figure 4:
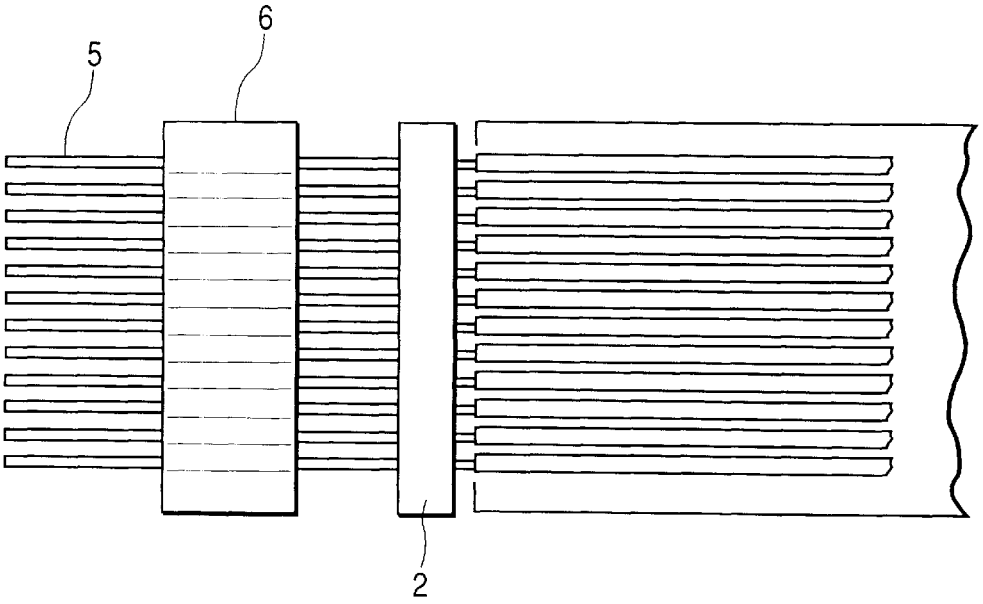
FIG. 4 illustrates how the insulated cores are fixed at a predetermined pitch by heat-fusing a plastic tape to the outer insulated cores.
Figure 5:
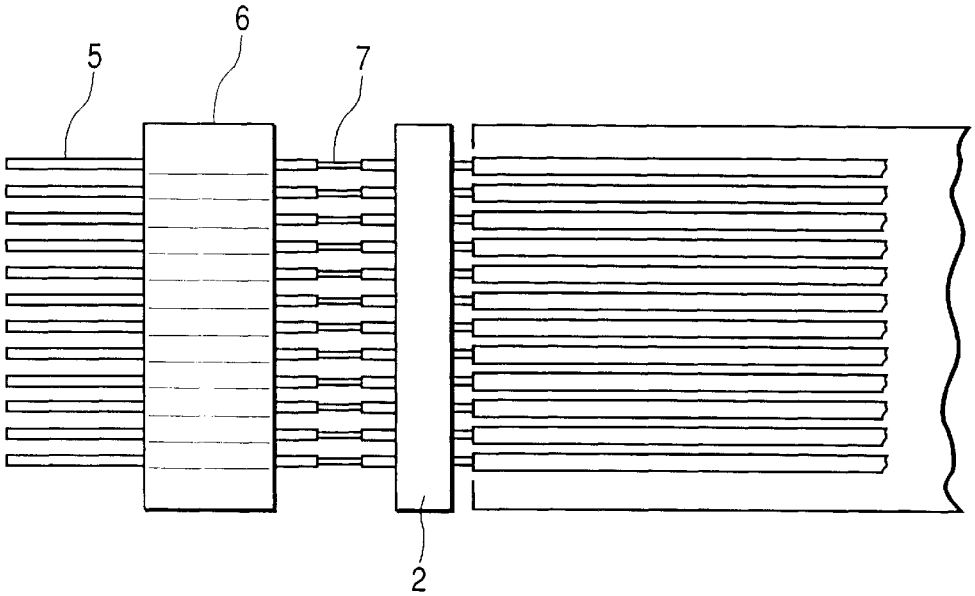
FIG. 5 illustrates how the core conductors are exposed by shifting the insulators remote from the combination of cables at a slit formed between the ground bar and the plastic tape.

An insulating film 6 was then heat-fused to the insulators 5 while the pitch therebetween was being maintained as shown in FIG. 4 so that these insulators 5 were fixed at the pitch. Subsequently, the combination of cables was irradiated with laser beam at the insulators 5 between the insulating film 6 and the ground bar 2 so that a slit was formed thereon. As shown in FIG. 5, the side of the combination of cables which had been fixed at the pitch with an insulating film was shifted outward so that the core conductors 7 were exposed.

Figure 6:
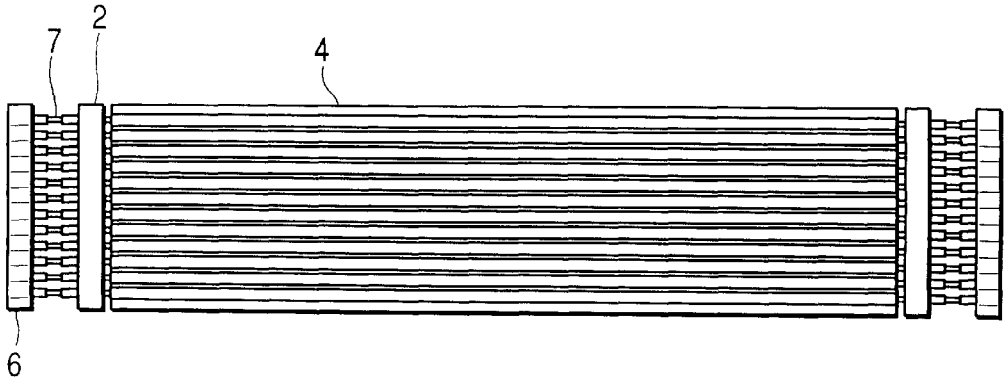
FIG. 6 illustrates an electric wire work completed by cutting the combination of cables at both ends thereof.

The combination of cables was then cut at a position outside the insulating film 6 with which the insulators had been fixed at the pitch to complete an electric wire work whose terminal had been processed so as to facilitate collective connection as shown in FIG. 6.

Figure 7:
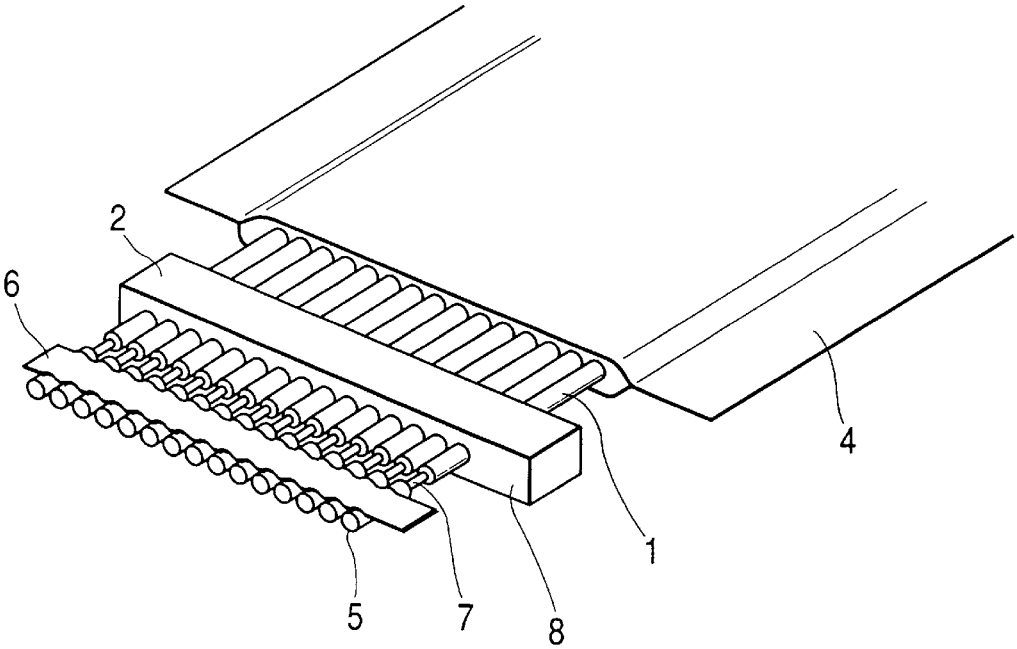
FIG. 7 is an enlarged view of the end of the completed electric wire work.

FIG. 7 is a perspective view illustrating completed electric wire work according to the present invention. Further, the ends of this electric wire work may be dipped in a solder bath so that the core conductors 7 made of twisted wires are coated with solder to further improve the working efficiency of the collective connection.

Moreover, the adhesive tape may be peeled off the combination of cables to provide a convenient electric wire work which is fixed at the predetermined pitch only at the ends thereof but is free at the other part.

In the electric wire work according to the present invention, the cables are fixed at a predetermined pitch with a ground bar and an insulating tape and the core conductors of the cables are exposed. In this arrangement, connection to the terminal of connectors and a circuit on boards can be collectively effected with ease, giving a high reliability in connection and providing the connection with a sufficient mechanical strength. This effect can be further exerted by coating the core conductor made of twisted wires with solder. Further, since the external conductors are collectively conducted through a ground bar, they can be easily grounded. Moreover, when the adhesive tape is peeled off the combination of cables, the cables are fixed at the predetermined pitch only at the ends thereof, making it possible to increase the degree of freedom of wiring or freedom of use of circuit thus wired.

Effects exerted by the electric wire work itself have been described. The procedure for the production of the electric wire work has the following features.

In order to expose the spirally wound external conductor by shifting the coating, a slit is formed on the coating by irradiating the coating with laser beam. Since the coaxial cable to be used in the present application comprises a copper-metallized polyester tape layer on the spirally wound external conductor, the insulator cannot be damaged by laser beam.

Further, in accordance with the present application, two sets of ground bars can be soldered to the external conductors thus exposed, and the external conductors of the plurality of coaxial cables can be collectively removed together with outer one of the two ground bars, making it possible to drastically increase the working efficiency.

That is claimed is:

1. A method of preparing a terminal wire connection, comprising in the following order:

cutting a combination of a plurality of coaxial cables to a predetermined length;

removing coatings from said coaxial cables in the vicinity of the ends thereof in a removing direction to expose external conductors;

fixing said external conductors at a predetermined pitch with two sets of ground bars at one of the ends of said coaxial cables, said two sets of ground bars being arranged such that one set of said two sets of ground bars are both laterally spaced from each other on one side of said coaxial cables and opposite from two associated ground bars on another side of said coaxial cables;

removing collectively in the removing direction a plurality of said external conductors together with an outer one of said two sets of ground bars to expose insulated cores, said two sets of ground bars being previously fixed to said external conductors, and said insulated cores including outer insulators and core conductors;

fixing said insulated cores at a predetermined pitch by disposing a fixing element including a plastic tape on said insulated cores laterally spaced from said remaining set of ground bars, and shifting said outer insulators in the removing direction to expose said core conductors.

2. The method according to claim 1, further comprising collectively coating with solder said exposed core conductors.

3. The method according to claim 1, wherein said removing coatings to expose said external conductors is carried out so as to expose a spirally wound shield layer and a copper-metallized polyester tape in combination forming said external conductors.

4. A method according to claim 1, wherein the removing of said coatings includes forming a transverse slit on said coatings with a laser beam and shifting said coatings in the removing direction.

* * * * *